US005445651A

United States Patent [19]

Thoen et al.

[11] Patent Number: 5,445,651

[45] Date of Patent: Aug. 29, 1995

[54] DETERGENT COMPOSITIONS INHIBITING DYE TRANSFER IN WASHING

[75] Inventors: Christiaan A. J. K. Thoen, Hassdonk; Adbennaceur Fredj, Brussels; James P. Johnston, Overijse, all of Belgium

[73] Assignee: The Procter & Gamble Company, Cincinnati, Ohio

[21] Appl. No.: 256,595

[22] PCT Filed: Jan. 22, 1993

[86] PCT No.: PCT/US93/00625

§ 371 Date: Jul. 18, 1994

§ 102(e) Date: Jul. 18, 1994

[87] PCT Pub. No.: WO89/09813

PCT Pub. Date: Oct. 19, 1989

[30] Foreign Application Priority Data

Jan. 31, 1992 [EP] European Pat. Off. ..... 92870018

[51] Int. Cl.[6] ..... C11D 3/28; C11D 3/30; C11D 3/386; C11D 3/395

[52] U.S. Cl. ..... 8/111; 8/137; 252/1; 252/95; 252/102; 252/104; 252/174.12; 252/524; 252/525; 252/529; 252/542; 252/544; 252/548; 252/DIG. 12

[58] Field of Search ..... 8/111, 137; 252/1, 102, 252/104, 174, 174.12, 174.17, 524, 525, 542, 544, 548, 529, 95

[56] References Cited

U.S. PATENT DOCUMENTS

| | | | |
|---|---|---|---|
| 3,640,877 | 2/1972 | Gobert | 252/99 |
| 4,065,257 | 12/1977 | Coe | 8/74 |
| 4,077,768 | 3/1978 | Johnston et al. | 8/107 |
| 4,261,868 | 4/1981 | Hora et al. | 252/529 |
| 4,372,882 | 2/1983 | Koster | 252/529 |
| 4,421,668 | 12/1983 | Cox | 252/174.12 |
| 4,853,143 | 8/1989 | Hardy | 252/102 |
| 5,194,416 | 3/1993 | Jureller | 502/167 |

FOREIGN PATENT DOCUMENTS

| | | |
|---|---|---|
| 0080223 | 11/1982 | United Kingdom . |
| 0369678 | 11/1989 | United Kingdom . |
| 0384503 | 1/1990 | United Kingdom . |
| 89/09813 | 10/1989 | WIPO . |
| WO91/0583 | 5/1991 | WIPO . |

*Primary Examiner*—Dennis Albrecht

*Attorney, Agent, or Firm*—Michael D. Jones; Jerry J. Yetter; Jacobus C. Rasser

[57] ABSTRACT

Dye transfer inhibiting compositions are disclosed, comprising: (A) a metallo catalyst selected from (a) metallo porphin and water-soluble or water-dispersible derivatives thereof; (b) metallo porphyrin and water-soluble or water-dispersible derviatives thereof; (c) metallo phthalocyanine and water-soluble or water-dispersible derivatives thereof; (B) an enzyme oxidation scavenger, (C) an enzymatic system capable of generating hydrogen peroxide, and (D) an enzyme, preferably selected from protease, lipase, amylase, and cellulase. The enzyme oxidation scavenger (B) operates to stabilize and protect the enzymes (D) from loss of activity in the wash.

24 Claims, No Drawings

DETERGENT COMPOSITIONS INHIBITING DYE TRANSFER IN WASHING

FIELD OF THE INVENTION

The present invention relates to a composition and a process for inhibiting dye transfer between fabrics during washing.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to bleach the fugitive dyes washed out of dyed fabrics before they have the opportunity to become attached to other articles in the wash.

Suspended or solubilized dyes can to some degree be oxidized in solution by employing known bleaching agents.

GB 2 101 167 describes a stable liquid bleaching composition containing a hydrogen peroxide precursor which is activated to yield hydrogen peroxide on dilution.

However it is important at the same time not to bleach the dyes actually remaining on the fabrics, that is, not to cause color damage.

U.S. Pat. No. 4,077,768 describes a process for inhibiting dye transfer by the use of an oxidizing bleaching agent together with a catalytic compound such as iron porphins.

Copending EP Patent Application 91202655.6 filed Oct. 9, 1991, relates to dye transfer inhibiting compositions comprising an enzymatic system capable of generating hydrogen peroxide and porphin catalysts.

Due to the presence of the oxidizing agents, the detergent enzymes such as protease, lipase, amylase, cellulase formulated with said dye transfer inhibiting composition have to perform their enzymatic activity in an oxidative environment, with a consequent loss of activity, especially in the absence of any bleeding dye.

It has now been found that improved stability of enzymes formulated with said enzymatic dye transfer inhibiting composition can be achieved by additing enzyme oxidation scavengers.

According to one embodiment of this invention an anzymatic dye transfer inhibiting composition is provided which is fully compatible with other enzymes and yet exhibits optimum dye transfer inhibiting benefits.

Accordingly, a dye transfer inhibiting composition is provided which exhibits optimum dye transfer inhibiting properties.

According to another embodiment, the invention provides an efficient process for laundering operations involving colored fabrics.

SUMMARY OF THE INVENTION

The present invention relates to inhibiting dye transfer compositions comprising:

A. a metallo catalyst selected from a) metallo porphin and water-soluble or water-dispersable derivatives thereof;

b) metallo porphyrin and water-soluble or water-dispersable derivatives thereof;

c) metallo phthalocyanine and water-soluble or water-dispersable derivatives thereof;

B. an enzyme oxidation scavenger

C. an enzymatic system capable of generating hydrogen peroxide.

According to another embodiment of this invention a process is also provided for laundering operations involving colored fabrics.

DETAILED DESCRIPTION OF THE INVENTION

The present invention provides a dye transfer inhibiting composition comprising:

A. a metallo catalyst selected from a) metallo porphin and water-soluble or water-dispersable derivatives thereof;

b) metallo porphyrin and water-soluble or water-dispersable derivatives thereof;

c) metallo phthalocyanine and water-soluble or water-dispersable derivatives thereof;

B. an enzyme oxidation scavenger.

C. an enzymatic system capable of generating hydrogen peroxide.

The Hydrogen Peroxide Precursor

The oxidizing agent, hydrogen peroxide is generated in situ by using an enzymatic hydrogen peroxide generation system.

The use of an enzymatic hydrogen peroxide generating system allows the continuous generation of low levels of hydrogen peroxide and provides a practical way of controlling a low steady-state level of hydrogen peroxide. Maximum effectiveness occurs when the component levels are such that the hydrogen peroxide is replenished at a rate similar to its removal due to the oxidation of dyes in the wash water. The enzyme used in the present invention is an oxidase. The oxidase is present by 0.1–20000 units, preferably 0.5 to 5000 units per gram of the composition. One unit is the amount of enzyme needed to convert 1 μmol of substrate per minute.

Suitable oxidases are urate oxidase, galactose oxidase, alcohol oxidases, amine oxidases, amino acid oxidases, cholesterol oxidase and glucose oxidase, malate oxidase, glycollate oxidase, hexose oxidase, aryl alcohol oxidase, L-gulonolactose oxidase, pyranose oxidase, L-sorbose oxidase, pyridoxine 4-oxidase, 2-2-hydroxyacid oxidase, choline oxidase, ecdysone oxidase.

The preferred enzymatic systems are alcohol and aldehyde oxidases, glucose oxidase.

The more preferred systems for granular detergent application would have solid alcohols, e.g. glucose whose oxidation is catalyzed by glucose oxidase to glucoronic acid with the formation of hydrogen peroxide.

The more preferred systems for liquid detergent application would involve liquid alcohols which could for example, also act as solvents. An example is ethanol/ethanol oxidase.

The quantity of oxidase to be employed in compositions according to the invention should be at least sufficient to provide in the wash a constant generation of 0.005 to 10 ppm AvO per minute. For example, with the glucose oxidase, this can be achieved at room temperature and at pH 6 to 11, preferentially 7 to 9 with 1–20000 U/l glucose oxidase, 0.005 to 0.5% glucose under constant aeration in the washing process.

Metallo Catalyst

The preferred usage range of the catalyst in the wash is $10^{-8}$ molar to $10^{-3}$ molar, more preferred $10^{-6}-10^{-4}$ molar.

The essential metallo porphin structure may be visualized as indicated in Formula I in the accompanying drawings. In Formula I the atom positions of the porphin structure are numbered conventionally and the double bonds are put in conventionally. In other formula, the double bonds have been omitted in the drawings, but are actually present as in I.

Preferred metallo porphin structures are those substituted at one or more of the 5, 10, 15 and 20 carbon positions of Formula I (Meso positions), with a phenyl or pyridyl substituent selected from the group consisting of

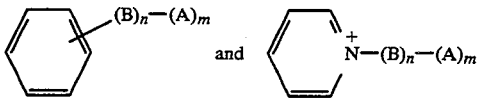

wherein n and m may be 0 or 1; A may be sulfate, sulfonate, phosphate or carboxylate groups; and B is $C_1$-$C_{10}$ alkyl, polyethoxy alkyl or hydroxy alkyl.

Preferred molecules are those in which the substituents on the phenyl or pyridyl groups are selected from the group consisting of $—CH_3$, $—C_2H_5$, $—CH_2CH_2CH_2SO_3—$, $—CH_2—$, and $—CH_2CH(OH)CH_2SO_3—$, $—SO_3$.

A particularly preferred metallo phorphin is one in which the molecule is substituted at the 5, 10 15, and 20 carbon positions with the substituent

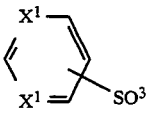

This preferred compound is known as metallo tetrasulfonated tetraphenylporphin. The symbol $X^1$ is (=CY—) wherein each Y, independently, is hydrogen, chlorine, bromine or meso substituted alkyl, cycloalkyl, aralkyl, aryl, alkaryl or heteroaryl.

The symbol $X^2$ of Formula I represents an anion, preferably $OH^-$ or $Cl^-$. The compound of Formula I may be substituted at one or more of the remaining carbon positions with $C_1$-$C_{10}$ alkyl, hydroxyalkyl or oxyalkyl groups.

(I)

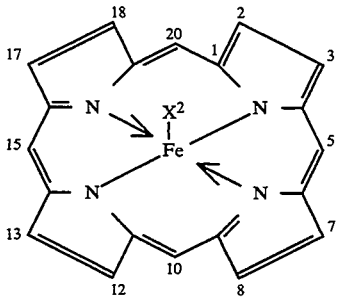

Porphin derivatives also include chlorophylls, chlorines, i.e. isobacterio chlorines and bacteriochlorines.

Metallo porphyrin and water-soluble or water-dispersable derivatives thereof have a structure given in formula II.

(II)

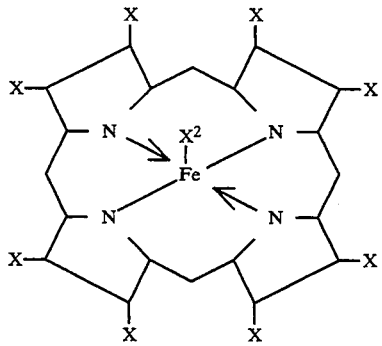

where X can be alkyl, alkyl carboxy, alkyl hydroxyl, vinyl, alkenyl, alkyl sulfate, alkylsulfonate, sulfate, sulfonate, aryl.

The symbol $X^2$ of Formula II represents an anion, preferably $OH^-$ or $Cl^-$.

The symbol $X_i$ can be alkyl, alkylcarboxy, alkylhydroxyl, vinyl, alkenyl, alkylsulfate, alkylsulfonate, sulfate, sulfonate.

Metallo phthalocyanine and derivatives have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are metallo phthalocyanine trisulfonate and metallo phthalocyanine tetrasulfonate.

(III)

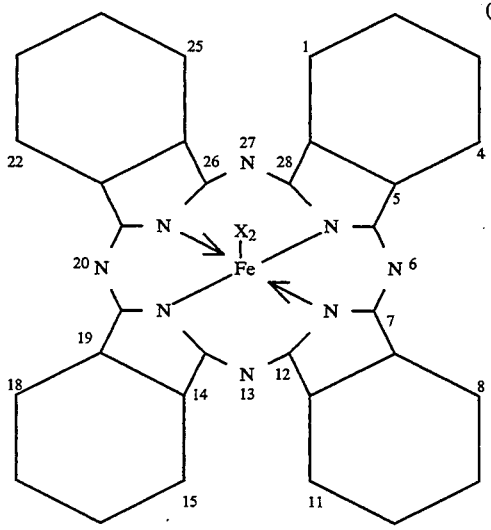

Another form of substitution possible for the present invention is substitution of the central metal by Fe, Mn, Co, Rh, Cr, Ru, Mo or other transition metals.

Still a number of considerations are significant in selecting variants of or substituents in the basic porphin or azaporphin structure. In the first place, one would choose compounds which are available or can be readily synthesized.

Beyond this, the choice of the substituent groups can be used to control the solubility of the catalyst in water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stains or stained surfaces and are therefore most likely not to cause attack on fixed dyes, whereas the cationic or zwitterionic compounds may be attracted to, or at least not repelled by such stained surfaces.

Enzyme Oxidation Scavenger

According to the present invention, it has now been found that improved stability of enzymes formulated with enzymatic dye transfer inhibiting compositions can be achieved by adding enzyme oxidation scavengers.

By enzyme oxidation scavengers is meant any chemical compound which, in the presence of the enzymatic dye transfer inhibiting system, is more readily oxidized than the enzyme but which is less readily oxidized than the dye bleeding from the fabrics. The enzyme oxidation scavengers of the present invention meet the following criteria:

First, the residual activity of the enzyme in the presence of the enzyme oxidation scavenger formulated with the dye transfer inhibiting composition of the present invention should be at least 60%, preferably more than 75% after 10 minutes of stirring at 20° C.

The amount of enzyme oxidation scavenger to be used in the present invention is dependent on the specific scavenger chosen and should be such that the above criteria has been met.

Thus, according to the present invention, a dye transfer inhibiting composition is provided which inhibits dye transfer while not adversely affecting the activity of the enzymes formulated therewith.

Preferred enzyme oxidation scavengers suitable for the present invention are amines and preferably tertiary amines having the formula

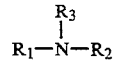

wherein $R_i$, $R_1$ and $R_2$ are either $C_1$–$C_{18}$ alkyl groups, aryl groups, alkyl alcohols or aromatic compounds; or wherein $R_i$, $R_1$ and $R_2$ can be part of an aliphatic or aromatic ring structure containing nitrogen.

Most preferred tertiary amines are compounds having the formula I wherein $R_1=R_2=C_2H_5$, $R_3=C_2H_4OH$ Other amines suitable for use as enzyme oxidation scavengers in the present invention are alkoxylated polyamines. Such materials can be conveniently represented as molecules of the empirical structures with repeating units:

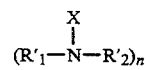

where $R'_1$, $R'_2$ are either $C_1$–$C_{18}$ alkyl groups, aryl groups, alkoxy or alkylalcohols, $n>1$ and X is an alkyl, aryl, substituted alkyl or aryl, alkoxy.

Most preferred are polyamines wherein $R'_1=R'_2=CH_2$, $X=(CH_2CH_2O)_mOH$, $1<n<12$ and $5<m<20$.

The level of the enzyme oxidation scavenger in the detergent composition is preferably from 0.0005 to 10%, more preferred from 0.001 to 7%, most preferred from 0.005 to 5%.

The present compositions are conveniently used as additives to detergent compositions for the main wash cycle.

The present invention also encompasses dye transfer inhibiting compositions which will comprise detergent ingredients and thus serve as detergent compositions.

The enzymes that can be formulated with present compositions are enzymes which can be active in the removal of soils or stains such as protease, lipase, amylase, carboxylase, peroxidases, cellulase or mixtures thereof.

DETERGENT INGREDIENTS

A wide range of surfactants can be used in the detergent compositions. A typical listing of anionic, nonionic, ampholytic and zwitterionic classes, and species of these surfactants, is given in U.S. Pat. No. 3,644,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14\text{-}15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\,(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are polyhydroxy fatty acid amide surfactants of the formula

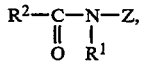

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R-CH(COOH)CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions for the purposes of this invention include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

The compositions of the present invention should be free from conventional bleaching agents. Other components used in detergent compositions may be employed, such as suds boosting or depressing agents, enzymes and stabilizers or activators therefore, soil-suspending agents soil-release agents, optical brighteners, abrasives, bactericides, tarnish inhibitors, coloring agents, and perfumes. Especially preferred are combinations with enzyme technologies which also provide a type of color care benefit. Examples are cellulase for color maintenance/rejuvenation.

These components, particularly the enzymes, optical brighteners, coloring agents, and perfumes, should preferably be chosen such that they are compatible with the bleach component of the composition.

The detergent compositions according to the invention can be in liquid, paste or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 90° C., especially 20 to 60, but the catalysts are effective at up to 95° C. The pH of the treatment solution is preferably from 7 to 11, especially from 7.5 to 10.5.

The process and compositions of the invention can also be used as additive during laundry operations.

The following examples are meant to exemplify compositions of the present invention, but are not necessarily meant to limit or otherwise define the scope of the invention, said scope being determined according to claims which follow.

General Test Conditions

To assess the stabilizing effect of the enzyme oxidation scavenger on the enzyme, the samples need to be free of dye since the dye also acts as a enzyme oxidation scavenger. The stability of the enzyme formulated with dye transfer inhibiting compositions are compared in the absence and presence of the enzyme oxidation scavenger. More in particular, the stability of protease was determined in the presence of iron porphin catalyst and glucose oxidase/glucose system.

I) in absence of enzyme oxidation scavenger

II) in presence of enzyme oxidation scavenger

Protease Activity

The protease activity is determined spectrophotometrically by measuring the absorbance at a wavelength of 410 nm. This corresponds to the formation of p-nitroaniline, which is the product of cleavage by a protease of a succinyl-Ala-Ala-Pro-Phe-p-nitroanilide. This pNA substrate (i.e. Succinyl Ala-Ala . . . ) is dissolved in dimethylsulfoxide (DMSO) using 1 ml or DMSO for 50 mg of the substrate. The dissolved substrate is kept frozen. Before testing for protease activity, a solution of the PNA substrate is prepared by diluting the substrate in Tris-buffer, pH 8.0 using a volume ratio of 1:20.

Approximately 100 μl of the diluted pNA substrate is added to a 1 ml sample, of the solution (I) or (II) to be analyzed, in a cuvette. The sample is then introduced in the spectrophotometer and the absorbance at 410 nm is monitored for approximately 5 min. The absorbance curve should be a straight line over the first few minutes (ca. 3 min). If this is not the case, then the solution (I) or (II) should be diulted with Tris-buffer. For instance, using the protease B Ex Genencor in the concentration mentioned above, the sample that gives a linear response is 100 μl of the solution and 900 μl of Tris-buffer, pH 8.0 (i.e. a dilution ratio of 1:9). A sample of the solution containing Savinase TM in the mentioned concentration gives a linear absorbance response (i.e. does not need to be diluted).

The slope of the absorbance curve is an indication of the protease activity. The % residual activity of solution (I) and (II) is determined relative to the slope obtained before adding the iron porphin catalyst and glucose/osidase system.

Dye Oxidation

The extent of dye oxidation is determined in a 100 mM phosphate buffer solution of 100 ml. The solution is continuously stirred in a beaker at a constant rate using a magnetic stirrer. The % of due oxidized is determined spectrophotometrically.

EXAMPLE 1

A. 0.1M phosphate buffer solution was prepared and its pH adjusted to 8.0. Then four 100 ml samples were prepared in separate beakers with the following compositions:

| |
|---|
| solution A: |
| 0.1 glucose oxidase units/ml |
| 10 ppm FE(III)TPPS |
| 0.1% glucose |
| 1.1 ppm BPN' (Ex-Genencor) |

-continued

| |
|---|
| solution A: |
| solution B: |
| solution A + scavenger |
| solution C: |
| 0.1 glucose oxidase units/ml |
| 10 ppm Fe(III)TPPS |
| 0.1% glucose |
| 40 ppm Direct Blue (CI #24410), absorbance peak at 600 nm |
| solution D: |
| solution C + scavenger |

The solutions were stirred at room temperature using a magnetic stirrer. The stability of protease and the amount of oxidized dye were determined according to the methods described in the text.

| solution oxidized | % residual activity or protease after 10 mins | % dye after 30 min |
|---|---|---|
| without scavenger | 45 | 77 |
| 0.05% dimethylaminoethanol | 75 | 76 |
| 0.01% diethylaminoethanol | 83 | 77 |

EXAMPLE II

The stability of protease B (Ex-genecor) was studied at a pH of 7.8 using the same concentrations and experimental conditions as example 1 except that the solution now contains 1% detergent. The ternary amine that was used for this test was an ethoxylated tetra ethylene pent amine (MW=4800) in a concentration of 30 ppm.

| activity solution oxidized | % residual or protease after 10 mins | % dye after 30 min |
|---|---|---|
| without scavenger | 25 | 100 |
| with scavenger | 100 | 100 |

EXAMPLE III

This experiment is similar to the one described in example I except for the following details: glucose oxidase concentration: 2 units/ml Fe(III) TPPS concentraion: 5 ppm enzyme: Savinase® (Ex-Novo) 32E-6 KNPU/ml 40 ppm Acid Red 151 (CI #26900), absorbance peak at (480–490 nm) 0.1M phosphate buffer at pH 10.5

| activity solution oxidized | % residual or protease after 10 mins | % dye after 30 min |
|---|---|---|
| without scavenger | 16 | 95 |
| 0.05% dimethylaminoethanol | 90 | 95 |

EXAMPLE IV

A liquid dye transfer inhibiting composition according to the present invention is prepared, having the following compositions:

| | % |
|---|---|
| Linear alkylbenzene sulfonate | 10 |
| Alkyl sulphate | 4 |

-continued

| | % |
|---|---|
| Fatty alcohol ($C_{12}$–$C_{15}$) ethoxylate | 12 |
| Fatty acid | 10 |
| Oleic acid | 4 |
| Citric acid | 1 |
| NaOH | 3.4 |
| Propanediol | 1.5 |
| Ethanol | 5 |
| Ethanoloxidase | 5 u/ml |
| Ferric tetrasulfonated tetraphenylporphin | 0.1 |
| ethoxylated tatraethylene pentamine | 0.3 |
| protease B ex-Genencor | 0.33 |
| Minors | up to 100 |

EXAMPLE V

A compact granular dye transfer inhibiting composition according to the present invention is prepared, having the following formulation:

| | % |
|---|---|
| Linear alkyl benzene sulphonate | 11.40 |
| Tallow alkyl sulphate | 1.80 |
| $C_{45}$ alkyl sulphate | 3.00 |
| $C_{45}$ alcohol 7 times ethoxylated | 4.00 |
| Tallow alcohol 11 times ethoxylated | 1.80 |
| Dispersant | 0.07 |
| Silicone fluid | 0.80 |
| Trisodium citrate | 14.00 |
| Citric acid | 3.00 |
| Zeolite | 32.50 |
| Maleic acid actylic acid copolymer | 5.00 |
| DETMPA | 1.00 |
| Cellulase (active protein) | 0.03 |
| Alkalase/BAN | 0.60 |
| Lipase | 0.36 |
| Sodium silicate | 2.00 |
| Sodium sulphate | 3.50 |
| Ferric tatrasulfonated tetraphenylporphin | 0.025 |
| Glucose | 10.00 |
| Glucose oxidase | 100 u/ml |
| diethylaninoethanol | 0.05 |
| Minors | up to 100 |

We claim:

1. A dye transfer inhibiting composition comprising:

A. a metallo catalyst present in an amount to provide from about $10^{-8}$ molar to $10^{-3}$ molar in a wash liquor, said metallo catalyst selected from a) metallo porphin and water-soluble or water-dispersible derivatives thereof;

b) metallo porphyrin and water-soluble or water-dispersible derivatives thereof;

c) metallo phthalocyanine and water-soluble or water-dispersible derivatives thereof;

B. from about 0.0005 to about 10%, by weight of total composition, of an enzyme oxidation scavenger, wherein said enzyme oxidation scavenger is more readily oxidized than enzyme (D) but less readily oxidized than a dye present is said wash liquor, said enzyme oxidation scavenger is selected from the group consisting of i) amines having the formula

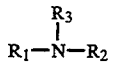

wherein $R_1$, $R_2$, $R_3$ are either $C_1$–$C_{18}$ alkoxy groups, aryl groups, alkyl alcohols or aromatic compounds or where $R_1$, $R_2$, $R_3$ can be part of an aliphatic or aromatic rings structure containing nitrogen; and ii) polyamines having the formula

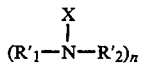

wherein $R'_1$, $R'_2$ are either alkyl groups, aryl groups, alkoxy or alcohols, $n<1$ and X is alkyl, alkoxy, aryl, C. an enzymatic system capable of generating hydrogen peroxide at a concentration of from 0.005 to 10 ppm/min in said wash liquor; and D. a cleaning effective amount of an enzyme selected from the group consisting of protease lipase, amylase, cellulase, and mixtures thereof; provided that the residual activity of said enzyme (D) in the presence of said enzyme oxidation scavenger (C) is at least 60%.

2. A dye transfer inhibiting compositions according to claim 1 wherein said amine base catalyst stabilizer is selected from imidazole and derivates thereof.

3. A dye transfer inhibiting composition according to claim 1 wherein $R_1=R_2=C_2H_5$, $R_3=C_2H_4OH$.

4. A dye transfer inhibiting composition according to claim 1 wherein $R'_1=R'_x=CH_2$, $X=(CH_2CH_2O)_mH$, $1<n<12$ and $5<m<20$.

5. dye transfer inhibiting composition according to claim 1 wherein said enzymatic system comprises an oxidase and as a substrate an alcohol, an aldehyde or a combination of both.

6. A dye transfer inhibiting composition according to claim 1, containing a metallo porphin derivative, wherein said iron porphin is substituted on at least one of its meso positions with a phenyl or pyridyl substituent selected from the group consisting of

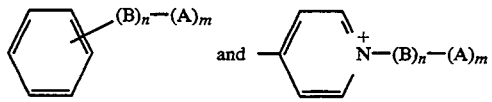

wherein n and m may be 0 or 1, A is selected from the group consisting of sulfate, sulfonate, phosphate, and carboxylate groups, and B is selected from the group consisting of $C_1$–$C_{10}$ alkyl, $C_1$–$C_{10}$ polyethoxyalkyl and $C_1$–$C_{10}$ hydroxyalkyl.

7. A dye transfer inhibiting composition according to claim 1 wherein the substituents on the phenyl or pyridyl groups are selected from the group consisting of $—CH_3$, $—C_2H_5$, $—CH_2CH_2CH_2SO_3—$, $—CH_2COO—$, $—CH_2C—H(OH)CH_2SO_3—$, and $—SO_3$.

8. A dye transfer inhibiting composition according to claims 1, containing a metallo porphin derivative, wherein said metallo porphin is substituted on at least one of its meso positions with a phenyl substituent selected from the group consisting of

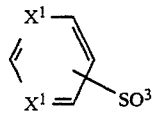

wherein $X^1$ is (=CY−) wherein each Y, independently, is hydrogen, chlorine, bromine or meso substituted alkyl, cycloalkyl, aralkyl, aryl, alkaryl or heteroaryl.

9. A dye transfer inhibiting composition according to claim 5 wherein the catalyst compound is metallo tetrasulfonated tetraphenylporphin.

10. A dye transfer inhibiting composition according to claim 1 wherein the metallo of said metallo catalyst is substituted by Fe, Mn, Co, Rh, CR, Ru, Mo or other transition metals.

11. A dye transfer inhibiting composition according to claim 1 wherein the concentration of metallo catalyst is from $10^{-8}$ to $10^{-3}$ molar.

12. A dye transfer inhibiting composition according to claim 3 wherein the oxidase is present by 0.1–20000 units per gram of the composition.

13. A dye transfer inhibiting composition according to claim 3 wherein said substrate is glucose.

14. A dye transfer inhibiting composition according to claim 3 wherein said substrate consists of a $C_1$–$C_6$ alcohol.

15. A dye transfer inhibiting composition according to claim 8 wherein said substrate is ethanol.

16. A dye transfer inhibiting composition according to claim 1 in which the substrate is present from 0.1 to 50% by weight of the composition.

17. A dye transfer inhibiting composition according to claims 1 wherein said enzyme oxidation scavenger is present in an amount from 0.005 to 5% by weight of the total composition.

18. A dye transfer inhibiting composition according to claims 1 which is a detergent additive, in the form of a non-dusting granule or a liquid.

19. A detergent composition which comprises a dye transfer inhibiting composition according to claim 1 further comprising an effective amount of surfactants, builders, and other conventional detergent ingredients.

20. A process for inhibiting dye transfer between fabrics during laundering operations involving colored fabrics, said process comprising contacting said fabrics with a laundering solution containing a dye transfer inhibition composition according to claim 1.

21. A process for inhibiting dye transfer according to claim 20 which is carried out at a temperature in the range of from 5° C. to 90° C.

22. A process for inhibiting dye transfer according to claim 20 wherein the pH of the bleaching bath is from 7 to 11.

23. A dye transfer inhibiting composition according to claim 11 wherein the concentration of the metallo catalyst is from $10^{-6}$ to $10^{-4}$ molar.

24. A dye transfer inhibiting composition according to claim 12 wherein the oxidase is present at from 0.5 to 5000 units per gram of the composition.

* * * * *